United States Patent [19]

Taglang et al.

[11] 4,259,413

[45] Mar. 31, 1981

[54] COMPOSITE STAINLESS STEEL BORON-CONTAINING ARTICLE

[75] Inventors: Richard J. Taglang; Walter C. Ziolkowski, both of Reading, Pa.

[73] Assignee: Carpenter Technology Corporation, Reading, Pa.

[21] Appl. No.: 35,631

[22] Filed: May 3, 1979

Related U.S. Application Data

[63] Continuation of Ser. No. 797,555, May 16, 1977, abandoned.

[51] Int. Cl.[3] ..... B22F 3/00

[52] U.S. Cl. ..... 428/548; 428/558; 75/208 R

[58] Field of Search ..... 75/708 R; 428/558, 548

[56] References Cited

U.S. PATENT DOCUMENTS

| | | | |
|---|---|---|---|
| 3,824,097 | 7/1974 | Smythe et al. | 75/208 R |
| 3,893,852 | 7/1975 | Bergman et al. | 75/226 |
| 3,955,972 | 5/1976 | Miller | 75/129 |
| 3,966,422 | 6/1976 | Kelley | 75/203 |
| 3,982,934 | 9/1976 | Wentzell | 75/226 |

*Primary Examiner*—Brooks H. Hunt
*Attorney, Agent, or Firm*—Edgar N. Jay

[57] ABSTRACT

A shaped article is provided having a composite structure made up primarily of a substrate which can be cold worked, if at all, only with a disproportionate amount of scrap and a cladding which is compatible with and highly ductile relative to the substrate and which at least during forming, particularly cold rolling, is thick enough and adherent to permit substantial reductions without exposing the hard-to-work substrate. The article is made by filling a container with prealloyed metal powder having the composition desired in the substrate including an ingredient which makes it hard to work. The container has a compatible composition, the substrate composition without the hard-to-work ingredient being illustrated. The container is then sealed, hot compacted, hot rolled and then cold rolled to final thickness to provide a shaped article having a substrate of the hard-to-work composition with an integral cladding metallurgically bonded thereto. In a preferred example, the substrate is made of type 304 stainless steel with 1.75% boron and the cladding is type 304 without a boron addition.

4 Claims, No Drawings

COMPOSITE STAINLESS STEEL BORON-CONTAINING ARTICLE

CROSS REFERENCES

This application is a continuation of application Ser. No. 797,555 filed by R. J. Taglang and W. C. Ziolkowski on May 16, 1977 now abandoned.

This invention relates to a method for making shaped articles such as strip, wire, bar or sheet from extremely difficult-to-work compositions with or without nonmetallic constituents and the product thereof and, more particularly, to such a process for making shapes containing substantial amounts of boron and the product made thereby.

It is well known that alloys having desirable properties and which can be manufactured into desired shapes such as strip, sheet, bar, rod or wire with a high proportion of useful product to scrap can be transformed into a material which is extremely difficult to work by additions which are required to impart a required property. For example, the presence of significant amounts of hardeners or wear-resistance imparting agents such as carbides or refractory oxides or of an element such as boron to modify the thermal neutron absorption cross section of an otherwise hot and/or cold workable material renders such material difficult to work, and the amount of material unusable except as scrap adds to the cost of the usable material. Further, as the proportion of such additions increases, the proportion of scrap to usable material has also increased, not necessarily proportionately, and sometimes rapidly becomes so large that cold working can no longer be carried out economically, and even hot working, if at all, can only be effected with considerable difficulty.

It has also hitherto been recognized that difficulties associated with casting and working difficult-to-work alloys may be reduced, if not eliminated, by utilizing powder metallurgical techniques. For example, Smythe U.S. Pat. No. 3,824,097 granted July 16, 1974 relates to a process for producing billets of metals and metal alloys wherein powder masses within a sealed ductile container are subjected to two compaction steps, first hot isostatic pressing and then extrusion to produce a billet from which the container is removed before further processing of the billet is carried out. Bergman U.S. Pat. No. 3,893,852 granted July 8, 1975 and Kelley U.S. Pat. No. 3,966,422 granted June 29, 1976 also relate to powder metallurgical processes in which a powder mass is placed in a container for densification and removed therefrom before final shaping. Wentzell U.S. Pat. No. 3,982,934 granted Sept. 28, 1976 relates to a powder metallurgical process in which a non-selfsupporting shell corresponding to the appropriate calculated pre-press size of the final part is formed on a male casting which is subsequently removed from the shell while the latter is enclosed in a support medium. The thus-supported empty shell is then filled with metal powder, and the entire assembly including the support medium is enclosed in an outer container which is evacuated, sealed and isostatically hot pressed. The outer container and support medium are removed to provide the final article with or without the non-selfsupporting shell as desired. Miller U.S. Pat. No. 3,955,972 granted May 11, 1976 relates to a process for making stainless steel sheet containing substantial amounts of boron from slabs of the same composition in which the slabs are enclosed in, but not bonded to, a mild carbon steel cladding to form a pack which is reduced by repeated hot rolling to the desired thickness, and then the pack is removed from the boron-containing stainless steel. The boron-containing steel thus produced by hot rolling cannot be cold worked as is pointed out in that patent and, therefore, can be shaped, if at all, only with difficulty and substantial waste.

SUMMARY OF THE INVENTION

It is, therefore, a principal object of this invention to provide an improved method for making shaped articles of difficult-to-work material as well as the product of such process.

A further object is to provide such a process which is especially suited to make articles of stainless steel containing substantial amounts of boron which enhances to a unique degree the proportion of useful material provided thereby.

A more specific object is to provide such a process which radically modifies the workability, both hot and cold, of material which is usually considered to be unformable for practical purposes by known cold working techniques, and which provides hot and/or cold worked articles or products essentially free of edge checks and breaks, capable of being further shaped or cold worked to provide a final product also substantially free of edge checks and breaks.

A further object is to provide such a process the finished products of which are characterized by a unique composite microstructure and which have improved mechanical properties particularly ductility, drawability and weldability, and having corrosion characteristics at least as good as that of products produced from the core material using previously known metallurgy (including powder metallurgy) techniques.

Much of the foregoing is attained by placing powder of the normally difficult-to-work material into a container which is sealed, hot compacted, and then hot and cold worked to provide a shaped article which may be in the form of a strip, sheet, bar, rod, wire or the like. It is an essential feature of the present process that the shaped article provided thereby is an integral but composite body having a cladding formed by the container material integrally joined throughout its extent to a core or substrate of substantially theoretical density formed from the prealloyed powder. It is important in practicing this invention that the interior of the container be properly prepared before the powder is added. Cleaning with a solvent to remove foreign matter, though desirable, is not sufficient because all adherent material or coatings including oxides formed on the interior surface of the container must be removed if the metallurgical bond characteristic of the present invention between the cladding and the substrate is to be attained.

The material of which the container is formed should be compatible with the composition of the prealloyed powder with which it is to be filled. It is highly advantageous but not essential to use a container formed from material which has an analysis close to that of the prealloyed powder filling, but without those additions thereto which render the powder difficult to work. While the wall thickness of the container is small compared to the smallest dimension of its cavity, e.g. its thickness or diameter in the case of a bar, it must be thick enough to provide a cladding which after one or more reductions is still thick enough so that the final sizing such as by cold rolling to the finished size of the shaped article has the benefit of the easily worked cladding.

DESCRIPTION OF THE DRAWING

Further objects and advantages of the present invention will be apparent from the following detailed description and the accompanying drawing which is a reproduction of a photomicrograph showing the integral metallurgical bond, magnified 500×, between the substrate and the cladding along a portion of the interface therebetween in accordance with the present invention.

DETAILED DESCRIPTION

In carrying out the process of the present invention, the prealloyed powder of the difficult-to-work composition to be used can be prepared in any convenient way, but the atomization process used should be compatible with the material, having in mind such factors as its composition, properties and intended use. For example, an alloy having a large boron content is preferably melted under vacuum and atomized by means of an inert gas atomizing fluid. The particle size of the prealloyed powder is not critical, but it is desirable to remove excessively large particles. Passing the powder through a 40 mesh screen for that purpose gave good results. It is advantageous that the prealloyed powder form of the hard-to-work material makes possible very close control of the composition to a desired analysis simply by blending powders from separate heats of the alloy. Thus, before the powder material is placed in its container, it is thoroughly blended to the desired average analysis.

The container for canning the prealloyed powder should have a composition that forms a bond with the compacted powder, when the assembly is hot pressed, which is strong enough to withstand the stresses developed during hot and cold working including hot and cold rolling. When the intermediate product to be formed is a billet or slab from which strip, sheet, bar, rod, wire or the like is to be formed, the container preferably has a substantially uniform wall thickness and forms a generally rectangular cavity into which the powder is fed through one or more tubulations. The wall thickness of the container is not critical, but must be thick enough to provide the thickness of cladding after successive reductions required for final forming and handling. When the materials are of substantially the same strength at all working temperatures, the container wall thickness and the core will be reduced proportionately thereby facilitating determination of the starting wall thickness to give a desired finished cladding thickness. Thus the container wall thickness should be thick enough to withstand at least 60%, preferably at least 90%, reduction and still provide a cladding thick enough for final reduction of the article to finished size. Good results are obtainable when the wall thickness of the container is large enough to provide a cladding at least about 0.005 in (0.127 mm) thick on the finished article or just before cold working to finished size.

The specific manner in which the prealloyed powders or the container are made form no part of the present invention. However, it is necessary that all material including oxides be removed from the interior surface of the container so that a metallurgical bond is formed between the interior of the container and the compacted powder when the filled container is hot pressed. For this purpose, cleaning with organic solvents is usually inadequate because oxides are usually present on the interior surfaces of the container even when it is made from stainless steel, and such oxides interfere with and prevent the formation of the bond required to withstand the forces generated during hot working, particularly hot rolling. For most container materials including Type 304 stainless, use of a solvent followed by chemical, e.g. acid cleaning, or, as is preferred, mechanical cleaning, as by sanding and/or sand blasting, serves to properly prepare the interior surface of the container. Any suitable arrangement for filling the containers can be used. A preferred arrangement is one which ensures that the powder entering the container is free of adsorbed water. Vacuum filling in which the powder feed and the interior of the container to be filled are in communication and maintained at a pressure of about 10 microns provides good results. Powder which has been thoroughly dried, as for example by heating in a fluidized bed, may be filled into the containers in a dry atmosphere, which could be air or an inert gas, at atmospheric pressure.

After the container has been filled with the metal powder preferably to maximum density such as is provided by using a vibratory feeder, and after elimination of air and water vapor, the container is sealed and then compacted. For maximum density, hot compaction gives best results, and preferably the sealed container is hot isostatically compacted to a shape such as a billet. As is well known, the temperature and pressure, and the duration through which the material is held at the temperature and pressure depend upon the materials involved and can readily be determined in each instance. The temperature to be used for a given material must be below its solidus temperature but, to minimize the time and pressure required, the highest temperature possible below the solidus is used that is compatible with the desired properties. In practice, the reduction in volume that occurs during compaction is readily determined and is taken into account when determining the starting dimensions of the container and its cavity. Nondestructive testing, as by means of ultrasonic techniques, indicates that hot isostatic compaction provides a good metallurgical bond between the container and its contents.

The compacted shape is then hot and/or cold worked to the desired shape, sufficient reduction in volume being effected to ensure the desired density. In the case of such articles as strip, sheet, bar, rod or wire, subjecting the compacted billet to further reduction of at least about 25% ensures theoretical density throughout. Hot rolling followed by cold rolling when necessary to meet dimensional tolerances and surface condition required in the finished article has been successfully used to provide articles of theoretical density having unique properties combined with an outstanding freedom from defects and with a substantial reduction in scrap.

The present process is especially suited for providing strip, sheet, plate, rod, bar, wire or other shaped articles formed of stainless steel containing so much boron as to be impossible to cold work for most, if not all, practical purposes. This is particularly true of type 304 stainless steel containing more than 1% boron. As much as 5% boron or as much more can be used as can be usefully incorporated in the substrate. A container for use with such boron-containing stainless steel can be made of various mild steel alloys, but best all-around results are provided by using type 304 steel without a boron addition to form the container. Not only does such container material ensure a close strength match with the boron-containing core material at all working temperatures, that is, temperatures encountered during hot and cold working or even during use of the final product, but also the mechanical and corrosion properties of the finished product are at least as good if not better than would be the case if the boron-containing type 304 were not provided with a cladding formed of type 304 but without a boron addition.

EXAMPLE 1

To illustrate the present invention, a powder blend was prepared from gas atomized powder that had been passed through a 40 mesh sieve and having an average composition by weight of about

| | w/o |
|---|---|
| C | 0.04 |
| Mn | 1.9 |
| Si | 0.6 |
| P | 0.02 |
| S | 0.008 |
| Cr | 18.9 |
| Ni | 13 |
| B | 1.75 |
| N | 0.01 |

and the balance iron plus incidental impurities. A type 304 stainless steel container having essentially the same composition but no more than residual boron was prepared having a thickness of 0.10 in (0.25 cm) and interior measurements of 8.675 in×3.675 in×58.750 in giving a volume before compaction of 1873 in$^3$ (22.03 cm×9.33 cm×149.23 cm or 30.67 dm$^3$). After degreasing and mechanical cleaning by sanding and sand blasting, the container was filled with 382 pounds (173.27 kg) of the blended powder under vacuum and sealed. Hot isostatic compaction was carried out at 2050° F. (1121° C.) under a pressure of 15,000 psi (1054.6 kg/cm$^2$). The resulting billet was 8 in×3.75 in×54 in (20.32 cm×9.53 cm×137.16 cm) giving a volume of 1620 in$^3$ (26.56 dm$^3$), and was hot rolled from a temperature of 2050° F. (1121° C.) to 0.180 in×8.875 in wide (0.457 cm×22.54 cm) rod which was then cold rolled to 0.125 in (0.318 cm) wide strip which was slit to a finish width of 8.5 in (21.6 cm). This material was then annealed at 1100° C., straightened and cut to a length of 145 in (368.30 cm).

The results of hot rolling were excellent and after cold rolling there were scratches and handling marks resulting in 52 lbs (23.6 kg) of scrap. This is to be compared to scrap rates of as much as 70% experienced with as little as 1% boron content in cold rolled type 304 prepared using prior techniques. It is to be expected that even higher scrap rates would result if type 304 stainless cold rolled strip containing 1.75% boron were attempted to be prepared using conventional techniques.

Based upon the volume and weight of the material and assuming uniform density, the density of the metal powder in the container prior to hot compaction was about 70% of theoretical, and after hot isostatic compaction, for 8 hours at the stated temperature and pressure, the density was roughly calculated to be greater than 90% of theoretical. After hot and cold working, the density was found to be 7.767 g/cc, theoretical density. The cladding was measured and found to be 0.005 inch (0.127 mm).

Referring to the drawing, the photomicrograph was prepared from a specimen taken from rolled strip made as was described in connection with Example 1 and shows a portion of the cladding "A" made of type 304 without boron, the substrate or core material "B" of the same composition to which 1.75% boron has been added and the interface between them generally indicated at "C" across which some boron has diffused for a short distance. It is particularly significant to note the small size and uniform distribution of the boride particles in substrate "B".

Standard mechanical property test specimens were prepared from the strip material for four tests from each end of the strip with each group of four specimens being made up of two transverse (T) and two longitudinal (L) specimens with respect to the rolling direction. In the following table under "Sample", "A" designates the end of the billet from which the strip was formed to which the filling tubulation was attached while "X" designates the opposite or bottom end of the billet. The results under yield strength (YS) and ultimate tensile strength (UTS) are given in thousands of pounds per square inch (ksi), and in kilograms per square centimeter (kgcm$^2$) and percent elongation, 2 inch (5.08 cm) gage is given under El.

| Sample | YS .2% ksi (kgcm$^2$) | UTS ksi (kgcm$^2$) | % El |
|---|---|---|---|
| AL | 64.2 (4514) | 116.4 (8184) | 21.9 |
| AL | 66.0 (4640) | 115.7 (8135) | 21.6 |
| AT | 63.2 (4443) | 114.1 (8022) | 21.2 |
| AT | 63.5 (4464) | 114.4 (8043) | 22.3 |
| XL | 64.3 (4521) | 116.9 (8219) | 23.6 |
| XL | 66.0 (4640) | 114.2 (8029) | 21.9 |
| XT | 62.4 (4387) | 112.7 (7924) | 21.9 |
| XT | 62.8 (4415) | 115.2 (8099) | 22.8 |

The results of these tests were reproducible to an unusual degree when tests were carried out on specimens made from additional examples of substantially the same composition and in the same way as was described in connection with Example 1. Cold worked boron-containing type 304 stainless steel when made in accordance with the present invention not only can be made with unusually high yields, but it is also characterized by improved properties. The material has enhanced ductility as well as formability and good weldability. It is especially significant that the formability of the shapes made in accordance with the present invention is significantly greater than that of type 304 stainless containing only 1% boron.

EXAMPLE 2

The present process can also be used to provide tool steels and other alloys containing relatively large amounts of carbides which are usually massive. Such steels, of which A.I.S.I. type T15 is an example, are also difficult to work as conventionally produced. For such prealloyed steel powder containing large amounts of carbon, the container is formed from a composition that is substantially the same as that of the hard-to-work material except for its carbon content, the container being limited to a carbon level which does not cause any difficulty in hot or cold rolling operations. Generally, less than 0.8%, preferably less than 0.4%, carbon should be present. Subsequently, if it is desired that the surface layer of the finished product also have a high carbon level, the article is carburized.

EXAMPLE 3

The present invention also lends itself to the production of ferromagnetic wear-resistant shaped articles such as those described in the copending application of F. W. Ackermann filed Jan. 19, 1976, Ser. No. 650,259, now U.S. Pat. No. 4,069,043 granted Jan. 17, 1978 and assigned to the assignee of the present application. In accordance with the present invention, the container is made of the ferromagnetic alloy without the refractory oxide and thus would contain in weight percent about

| | w/o |
|---|---|
| C | 0.025 |
| Mn | 0–2 |
| Ni | 70–85 |
| Cr | 0–5 |
| Mo | 0–6 |
| Cu | 0–6 |
| Ti | 0–1 |
| Nb | 0–1 |

with the balance iron and incidental impurities and the iron content being greater than 10%. Consistent with the description in connection with Example 1, the container is filled with powder of the same magnetic composition as the container with the addition of the refractory oxide which may range up to about 5%, but preferably no more than 2%. For this purpose, strip is prepared as was described in connection with Example 1 from a starting container thickness of 4 in (10.16 cm) with 0.1 in (0.25 cm) walls and hot and cold rolled to the desired thickness, e.g. 0.01 inch (0.254 mm) having a cladding of about 0.0004 in (0.01 mm). The strip is slit to expose the wear-resistant substrate along its edge, and such articles as laminated tape recorder heads are formed so that the tape, which tends to wear away the head, runs over the exposed substrate of the several laminations separated by the cladding of adjacent laminations, thus providing closely spaced regions of high wear resistance. For convenience, the disclosure of said co-pending application Ser. No. 650,259 is incorporated here by reference.

EXAMPLE 4

Another type of shaped article which hitherto could only be provided in the form of castings which are used as such or shaped by grinding or the like is that made entirely or largely of Sendust, a very brittle ferromagnetic alloy having a nominal composition of 10% silicon, 5% aluminum and the balance iron. When made in accordance with the present invention, prealloyed powder made up of more than 50% Sendust is placed in a container having desired ferromagnetic properties and further processing is carried out as described in connection with the preceding examples. One very useful shaped article is made by filling a container having the same composition as the container of Example 3 with a powder blended by mixing Sendust powder and powder of the container composition with the latter forming less than 50% of the blend.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Strip, wire, bar or sheet article having a brittle substrate of substantially fully densified stainless steel powder containing more than 1 weight percent boron, a stainless steel cladding on said substrate and metallurgically bonded thereto, said cladding containing from substantially no boron up to less than would embrittle said cladding, and said cladding being thick enough to withstand reduction incident to forming said article to a reduced final size.

2. The article set forth in claim 1 in which said stainless steel powder is type 304 plus said boron.

3. The article set forth in claim 2 in which said substrate contains up to about 5 weight percent boron.

4. The article set forth in claim 3 in which said cladding is type 304 stainless steel.

* * * * *

UNITED STATES PATENT AND TRADEMARK OFFICE

CERTIFICATE OF CORRECTION

PATENT NO. : 4,259,413

DATED : March 31, 1981

INVENTOR(S) : Richard J. Taglang & Walter C. Ziolkowski

It is certified that error appears in the above—identified patent and that said Letters Patent is hereby corrected as shown below:

Col. 3, line 3, delete "DESCRIPTION OF THE DRAWING"

line 7, after "scription" insert a period -- . --, same line 7, beginning with "and the" delete all to and including lines 11 and 12 "invention."

Col. 6, line 3, delete "Referring to the drawing," and change "the" to -- The --.

Col. 7, line 17, for "0.025" read -- <0.025 --

Signed and Sealed this

Thirtieth Day of June 1981

[SEAL]

Attest:

RENE D. TEGTMEYER

Attesting Officer

Acting Commissioner of Patents and Trademarks